US012680225B2

(12) United States Patent
Maeshima et al.

(10) Patent No.: US 12,680,225 B2
(45) Date of Patent: Jul. 14, 2026

(54) FOLDING ASSISTANCE DEVICE AND FOLDING APPARATUS INCLUDING FOLDING ASSISTANCE DEVICE

(71) Applicant: TOTOFOLDER MANUFACTURING CO.,LTD., Saitama (JP)

(72) Inventors: Yusuke Maeshima, Saitama (JP); Haruo Kojima, Saitama (JP)

(73) Assignee: TOTOFOLDER MANUFACTURING CO., LTD., Saitama (JP)

( * ) Notice: Subject to any disclaimer, the term of this patent is extended or adjusted under 35 U.S.C. 154(b) by 0 days.

(21) Appl. No.: 18/705,986

(22) PCT Filed: Nov. 9, 2021

(86) PCT No.: PCT/JP2021/041243

§ 371 (c)(1),
(2) Date: Apr. 29, 2024

(87) PCT Pub. No.: WO2023/084620

PCT Pub. Date: May 19, 2023

(65) Prior Publication Data

US 2025/0003142 A1 Jan. 2, 2025

(51) Int. Cl.
*D06F 89/02* (2006.01)

(52) U.S. Cl.
CPC ..... *D06F 89/023* (2013.01)

(58) Field of Classification Search
CPC ..... D06F 89/00; D06F 89/02; D06F 89/023
See application file for complete search history.

(56) References Cited

FOREIGN PATENT DOCUMENTS

| | | | | |
|---|---|---|---|---|
| ES | 451653 A1 * | 11/1977 | ..... | D06F 89/023 |
| JP | H01310700 | 12/1989 | | |
| JP | 2000202200 | 7/2000 | | |
| JP | 2008018100 A * | 1/2008 | | |
| JP | 2009233321 | 10/2009 | | |
| JP | 2014188064 | 10/2014 | | |
| KR | 20200028826 | 3/2020 | | |
| KR | 20210061617 | 5/2021 | | |
| WO | 2019229807 | 12/2019 | | |
| WO | WO-2021101150 A1 * | 5/2021 | ..... | D06F 89/02 |

OTHER PUBLICATIONS

Translation ES 451653.*
Translation JP 2008018100.*
"International Search Report (Form PCT/ISA/210) of PCT/JP2021/041243", mailed on Dec. 28, 2021, with English translation thereof, pp. 1-4.
"Search Report of Europe Counterpart Application", issued on Nov. 12, 2024, p. 1-p. 9.

* cited by examiner

*Primary Examiner* — Shaun R Hurley
(74) *Attorney, Agent, or Firm* — JCIPRNET

(57) ABSTRACT

There are provided a folding assistance device capable of reliably folding a fabric formed of a relatively rigid nonwoven fabric, as compared with a fabric formed of cotton or synthetic fiber, and a folding apparatus including the folding assistance device. A folding assistance device (10) includes a pressing portion (20) that is attached to a folding apparatus (200) including a gauge (211) defining a folding position for folding a fabric (W) and presses the gauge to fold the fabric at the folding position with the fabric interposed therebetween, and a driving portion (30) that drives the pressing portion to come into contact with the gauge.

19 Claims, 9 Drawing Sheets

FOLDING ASSISTANCE DEVICE AND FOLDING APPARATUS INCLUDING FOLDING ASSISTANCE DEVICE

CROSS-REFERENCE TO RELATED APPLICATION

This application is a 371 application of the International PCT application serial no. PCT/JP2021/041243, filed on Nov. 9, 2021. The entirety of the above-mentioned patent application is hereby incorporated by reference herein and made a part of this specification.

TECHNICAL FIELD

The present invention relates to a folding assistance device and a folding apparatus including the folding assistance device.

BACKGROUND ART

In related art, a device that folds clothes such as a uniform and a yukata is known, and there is provided a folding apparatus that has a plurality of folding steps such as folding the clothes in so-called body tri-folding, that is, performing French folding in which the width (in a short dimension direction) of the clothes is folded to be divided into three along a long dimension direction of the clothes, and then performing folding such that the clothes is divided into two in the long dimension direction.

For example, JP-A-2009-233321 discloses a folding apparatus that is compatible with double-sided folding of the clothes. The apparatus is provided with a pair of gauge bars 13 and 13 disposed substantially at an interval of a base of a sleeve on a conveyor, and a pair of sleeve folding portions 14 and 14 that is vertically movable between conveyor belts positioned slightly outside the pair of gauge bars 13 and 13 and are movable in a right-left direction to narrow or widen the interval.

In order to fold the clothes such as the uniform and the yukata in French folding, the pair of gauge bars 13 that is retreated to a position above a conveyor transport surface is lowered to press the vicinity of the base of the sleeve of clothes W. On the other hand, the pair of sleeve folding portions 14, which is retreated below the conveyor transport surface, is raised, and the pair of sleeve folding portions 14 is moved from the outside to the inside of the pair of gauge bars 13 to skim the upper side of the pair of gauge bars 13 to French-fold the fabric W.

On the other hand, recently, due to the outbreak of the infectious disease (COVID-19) caused by the novel coronavirus (SARS-COV-2), it is recommended to wear a nonwoven fabric gown, protective clothing, or the like in a medical site or the like to prevent infection with the virus. Such a nonwoven fabric gown and protective clothing are disposable and are replaced each time they are used once.

Therefore, there is a demand for the production of a large amount of nonwoven fabric gowns and protective clothing, and in a production stage thereof, a folding operation of folding the gowns and the protective clothing into a predetermined shape is automated to improve the production efficiency.

In this case, it is also conceivable to apply a double-sided folding-compatible folding apparatus that folds the clothes, but since the target is a gown or the like made of a nonwoven fabric having a higher tension than the clothes in related art, there is a problem that the clothes cannot be folded reliably.

Specifically, as described above, the fabric is French-folded by the movement of the pair of sleeve folding portions 14 along a pair of gauges that is the pair of gauge bars 13, but in a case of the nonwoven fabric having tension, that is, being relatively rigid, a problem may occur in that a portion once folded is returned to be restored and cannot be folded reliably along the pair of gauge bars 13.

In addition, not only such a fabric having tension but also the fabric in related art is required to be folded more reliably.

CITATION LIST

Patent Literature

[PTL 1] JP-A-2009-233321

SUMMARY OF INVENTION

Technical Problem

The present invention has been made in view of the above-described point, and an object of the present invention is to provide a folding assistance device capable of reliably folding a fabric formed of a relatively rigid nonwoven fabric, as compared with a fabric formed of cotton or synthetic fiber, and a folding apparatus including the folding assistance device.

Solution to Problem

In order to solve the above problems, a folding assistance device of a first viewpoint includes a pressing portion that is attached to a folding apparatus including a gauge that defines a folding position for folding a fabric and presses the gauge to fold the fabric at the folding position with the fabric interposed therebetween, and a driving portion that drives the pressing portion to come into contact with the gauge.

In addition, a folding assistance device for folding a fabric of a second viewpoint includes a pressing portion that is attached to a folding apparatus including a gauge that defines a folding position for folding a fabric and a conveyor that transports the fabric and presses the gauge to fold the fabric at the folding position with the fabric interposed therebetween, and a driving portion that drives the pressing portion to come into contact with the gauge, in which the fabric is transported by the conveyor while being pressed against a pair of the gauges by the pressing portion.

In addition, in the folding assistance device of a third viewpoint according to the first viewpoint or the second viewpoint, the driving portion is configured to adjust a pressing force for pressing the gauge with the fabric interposed therebetween.

In addition, in the folding assistance device of a fourth viewpoint according to the first to third viewpoints, the driving portion rotates the pressing portion in plan view to press the gauge with the fabric interposed therebetween.

In addition, in the folding assistance device of a fifth viewpoint according to the fourth viewpoint, the driving portion is a rotary actuator.

In addition, in the folding assistance device of a sixth viewpoint according to the first to third viewpoints, the driving portion makes the pressing portion go straight to press the gauge with the fabric interposed therebetween.

In addition, in the folding assistance device of a seventh viewpoint according to the sixth viewpoint, the driving portion is an air cylinder or an electric cylinder.

In addition, a folding apparatus of an eighth viewpoint includes the folding assistance device of the first to seventh viewpoints.

ADVANTAGEOUS EFFECTS OF INVENTION

Since the present invention is configured as described above and acts as described above, it is possible to provide a folding assistance device capable of reliably folding a fabric formed of a relatively rigid nonwoven fabric, as compared with a fabric formed of cotton or synthetic fiber, and a folding apparatus including the folding assistance device.

DESCRIPTION OF EMBODIMENTS

Figure 1:
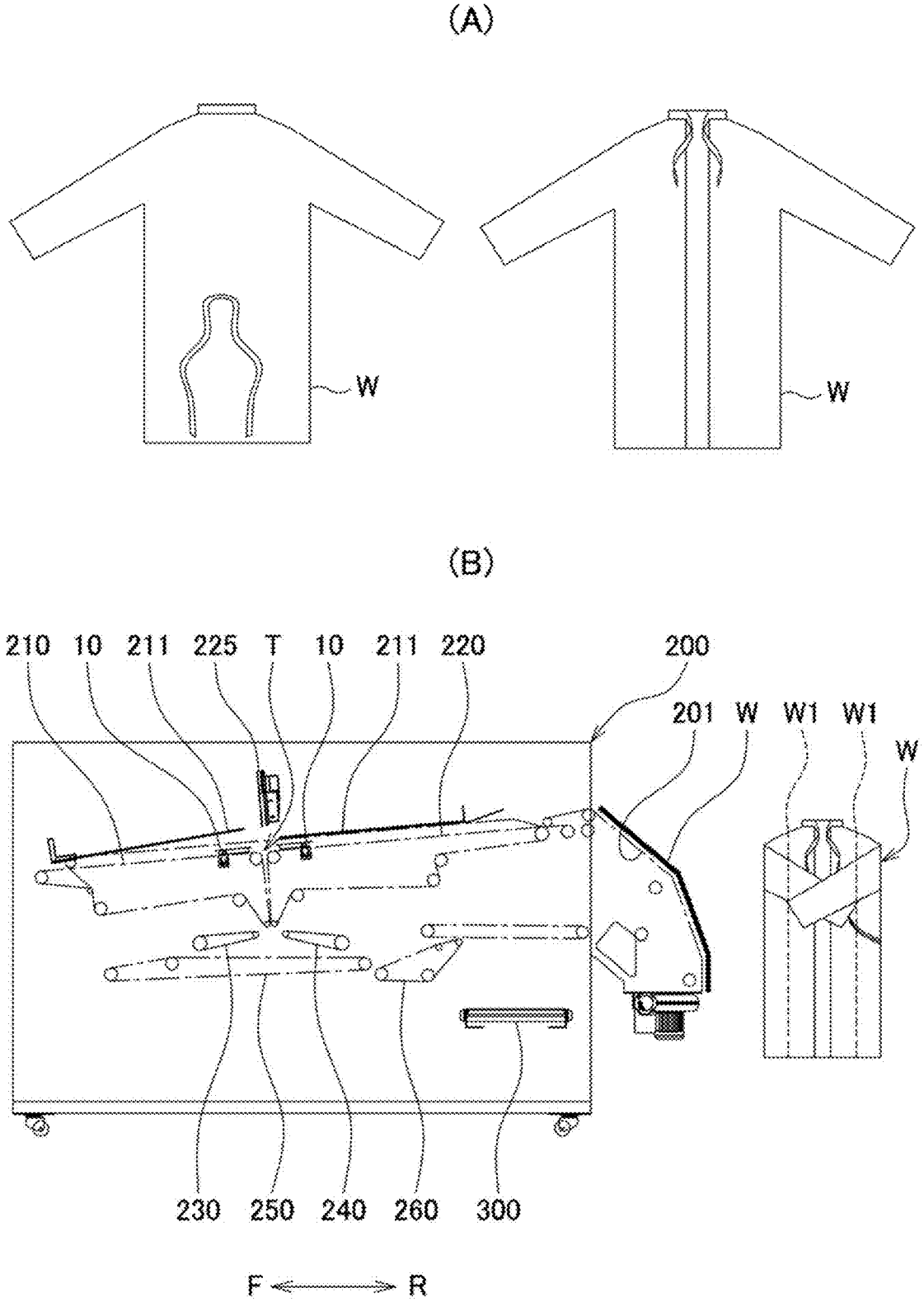
FIG. 1, A is a schematic view showing a front and a back of a fabric. B is a conceptual diagram showing a folding apparatus including a folding assistance device of a first example and a folding position of the fabric.
Figure 2:
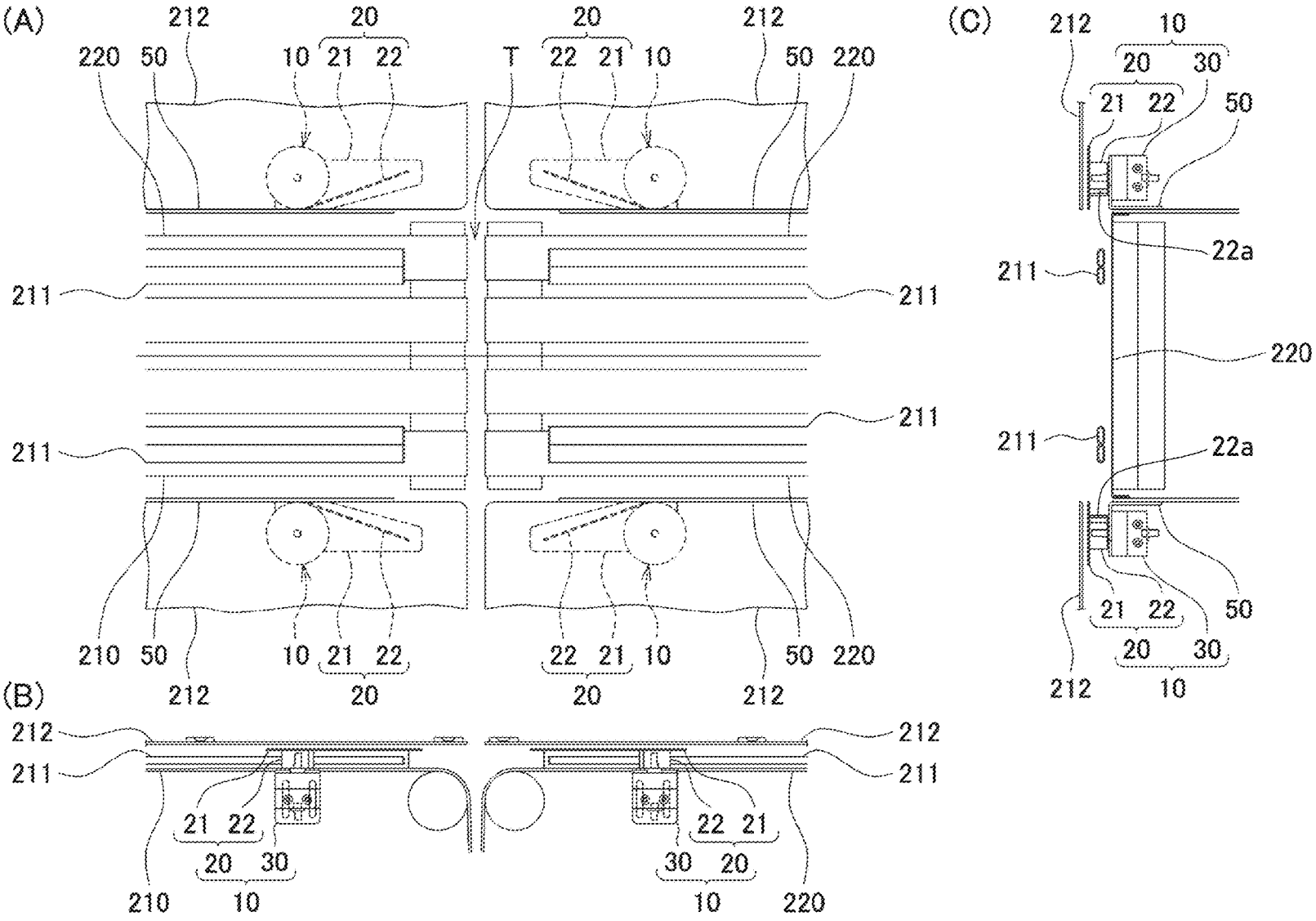
FIG. 2, A is plan view showing a state in which the folding assistance device of the first example is attached to the folding apparatus. B is a side view of A. C is a right side view of A.
Figure 3:
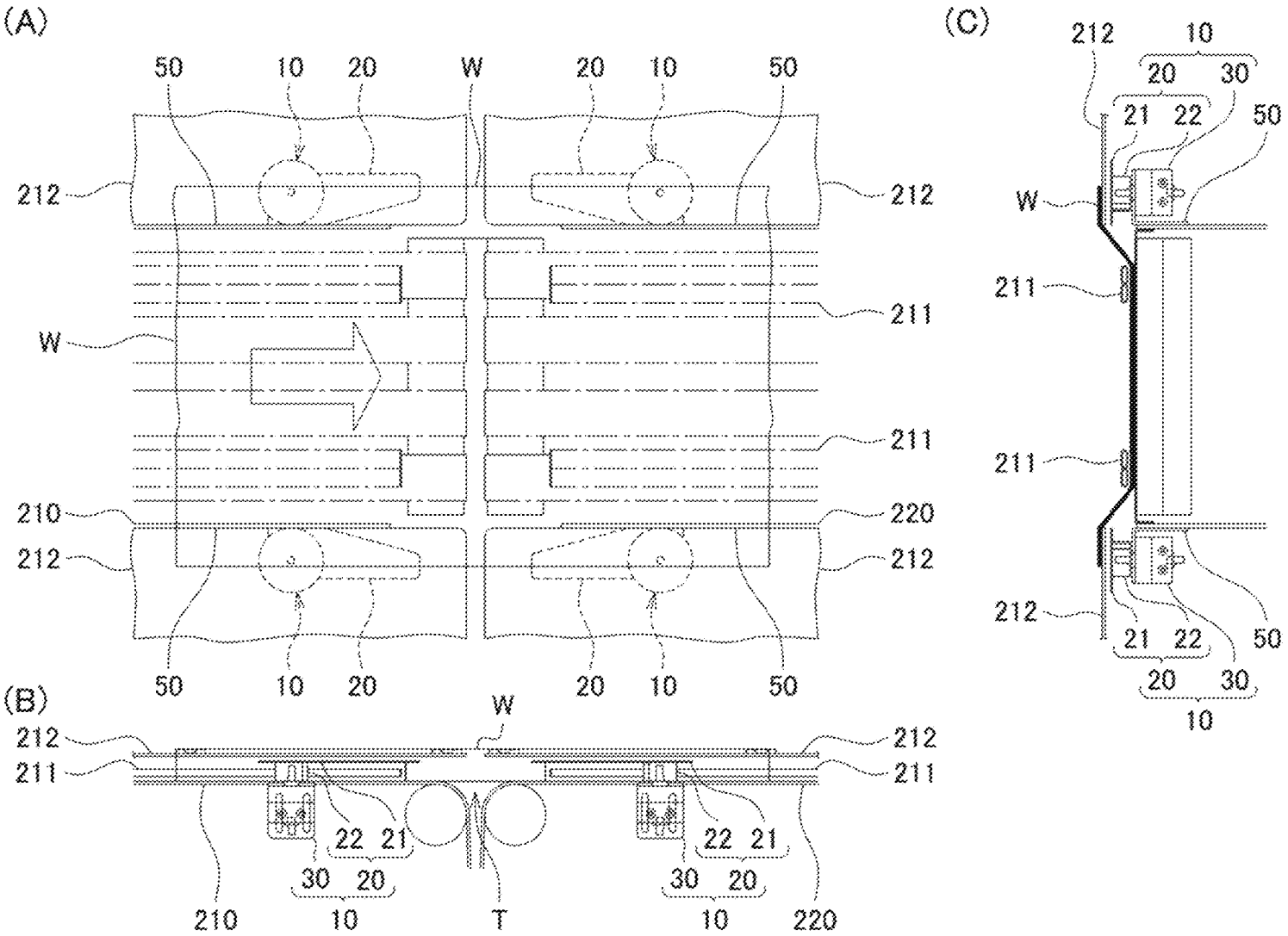
FIG. 3, A is a plan view of a state in which the fabric is disposed in the folding apparatus in a state in which the folding assistance device of the first example is attached to the folding apparatus. B is a side view of A. C is a right side view of A.

Hereinafter, a folding assistance device 10 of the first example will be described with reference to the illustrated embodiment. The folding assistance device 10 of the first example is attached to and used with a folding apparatus 200 in related art (refer to FIG. 1B). Here, the folding apparatus 200 will be briefly described. The folding apparatus 200 includes an insert conveyor 201 to insert a fabric W into the folding apparatus 200, a first conveyor 210 to transport the fabric W in a front F direction and a rear R direction, and a second conveyor 220 to transport the fabric W in the front F direction. The first conveyor 210 and the second conveyor 220 are disposed to have a gap T, the fabric W is disposed to straddle the gap T, and a folding knife 225 enters the gap T such that the fabric W is bi-folded in a vertical direction. In addition, two pairs of gauges 211 and 211 are disposed on the first conveyor 210. Here, the fabric W is preferably a gown formed of a nonwoven fabric, but is not limited thereto, and may be a towel or a bath towel.

In addition, the two pairs of gauges 211 and 211 are disposed on the first conveyor 210 and the second conveyor 220, and are used to define folding positions of the fabric W when the fabric W is folded along vertical directions W1 and W1 (folded along a long dimension direction to narrow the width of the fabric W, refer to FIG. 1A and B). In addition, a pair of folding portions 212 and 212 are disposed on both sides of the first conveyor 210, respectively. The pair of folding portions 212 and 212 are provided for folding the fabric W along the vertical directions W1 and W1 at positions defined by the two pairs of gauges 211 and 211, and are disposed on both sides of the first conveyor 210. The folding portions 212 and 212 preferably have a plate shape, but are not limited thereto.

In addition, the folding apparatus 200 includes the first conveyor 210, the second conveyor 220 that transports the fabric W in a front F direction, a third conveyor 230 that transports the fabric W in a rear R direction or the front F direction below the second conveyor 220, and a fourth conveyor 240 that is linked to the third conveyor 230 and transports the fabric W in the rear R direction. In addition, the folding apparatus 200 includes a fifth conveyor 250 that performs transport further in the rear R direction and a sixth conveyor 260. In addition, the folding apparatus 200 includes a stack portion 300 to stack the folded fabric W. As described above, the folding apparatus 200 itself that does not include the folding assistance device 10 of the first example is already known, and the number of conveyors can be further increased or decreased as necessary.

The folding assistance device 10 of the first example reliably folds the fabric W by the pair of folding portions 212 and 212 at positions defined by the pair of gauges 211 and 211. In addition, the folding assistance device 10 can be disposed in each of the first conveyor 210 and the second conveyor 220. In addition, the folding assistance device 10 includes a pressing portion 20 that presses the fabric W interposed between the gauges 211 disposed in the first conveyor 210 and the second conveyor 220, respectively, and a driving portion 30 that drives the pressing portion 20 to be in contact with the gauges 211 with the fabric W interposed therebetween.

The pressing portion 20 includes an upper end portion 21 that has a flat plate shape and a main body portion 22 that has a wedge shape in plan view below the upper end portion 21 and includes a side portion 22*a* having a predetermined thickness. In addition, the driving portion 30 drives the pressing portion 20 as it is to press the pressing portion 20 against the gauge 211. The predetermined thickness of the side portion 22*a* is preferably a thickness that does not interfere with the position at which the folding portion 212 operates.

In addition, as will be described later, it is preferable that the driving portion 30 can adjust the pressing force for pressing the fabric W interposed between the gauges 211 and 211. For example, as the driving portion 30, a rotary actuator that drives the pressing portion 20 to rotate in plan view is preferable. The rotary actuator operates with air pressure, and although the widths of the gauges 211 are changed according to the width of the fabric W, the pressing force of the driving portion 30 on the pressing portion 20 can be appropriately adjusted, and thus the fabric W is not damaged.

The fact that the pressing force of the driving portion 30 on the pressing portion 20 is adjustable, for example, in a case where the driving portion 30 is a rotary actuator driven by air pressure, can prevent the pressing portion 20 from being too strong and causing the first conveyor 210 or the second conveyor 220 to stop the transport of the fabric W, and prevent the pressing portion 20 from being too weak and not being able to press the fabric W, by adjusting the air pressure of the rotary actuator, which is the driving portion 30, in advance according to the type of the fabric W by an operator (not shown).

That is, when the fabric W is transported by the first conveyor 210 or the second conveyor 220, the transport by the first conveyor 210 or the second conveyor 220 is stopped when the fabric W is excessively pressed by the pressing portion 20, but by adjusting the air pressure of the rotary actuator, which is the driving portion 30, in advance, the pressing force on the pressing portion 20 is adjusted, so that the transport by the first conveyor 210 or the second conveyor 220 is prevented from being stopped. In this way, by adjusting the pressing force of the driving portion 30, there is no resistance against the transport force of the first conveyor 210 or the second conveyor 220. Therefore, the pressing force of the driving portion 30 on the pressing portion 20 does not resist the transport force of the first conveyor 210 or the second conveyor 220, and the productivity is not reduced due to the stopping of the transport.

Next, a method of attaching the folding assistance device 10 of the first example to the folding apparatus 200 will be described. In the folding apparatus 200, the folding assistance device 10 of the first example is disposed in each of the first conveyor 210 and the second conveyor 220. In plan view, the folding assistance device 10 is attached to, in a direction perpendicular to the transport direction of the first conveyor 210, for example, in a case where the first conveyor 210 is compared to a river, positions corresponding to both banks of the river via the attachment portion 50. Specifically, the driving portion 30 is attached to the attachment portion 50, and the pressing portion 20 is attached to the driving portion 30.

Next, a method of using the folding apparatus 200 to which the folding assistance device 10 of the first example is attached will be described. First, a sleeve portion of the fabric W is folded and the fabric W is inserted into the insert conveyor 201 (refer to FIG. 1A and B). The fabric W is transported, and the transport is performed such that the fabric W straddles the first conveyor 210 and the second conveyor 220. In this state, the two pairs of gauges 211 and 211 are lowered onto the fabric W, and the fabric w is pressed onto the first conveyor 210 or the second conveyor 220. In this case, the two pairs of gauges 211 and 211 are placed at positions that divide the fabric W in a width direction into three (the vertical directions W1 and W1 of the fabric W, refer to FIG. 1A and B), and then the two pairs of folding portions 212 and 212 move, in a case where the transport by the conveyor is compared to a flow of a river, from positions abutting both banks of the river in an alternating manner to a position corresponding to a so-called center portion of the river to skim the upper side of the gauges 211 and 211 from the positions abutting both banks of the river, respectively, so that so-called French folding (body tri-folding) is performed along the long dimension direction of the fabric W and at the positions that divide the fabric W in the width direction into three (the vertical direction W1 and W1 of the fabric W).

Figure 4:
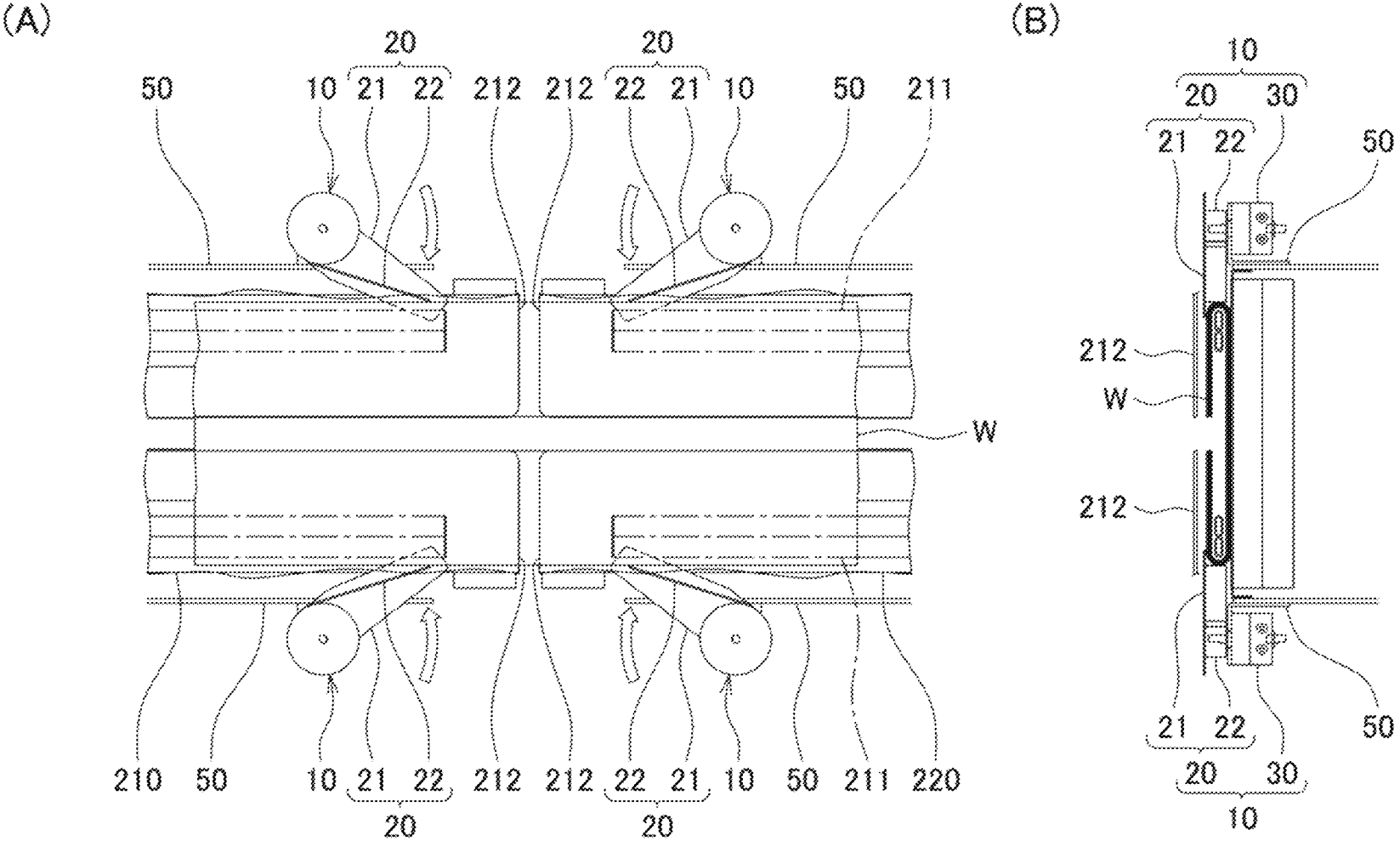
FIG. 4, A is a plan view showing a state in which the fabric is vertically tri-folded (French folding) in a state in which the folding assistance device of the first example is attached to the folding apparatus. B is a right side view of a state of A.
Figure 5:
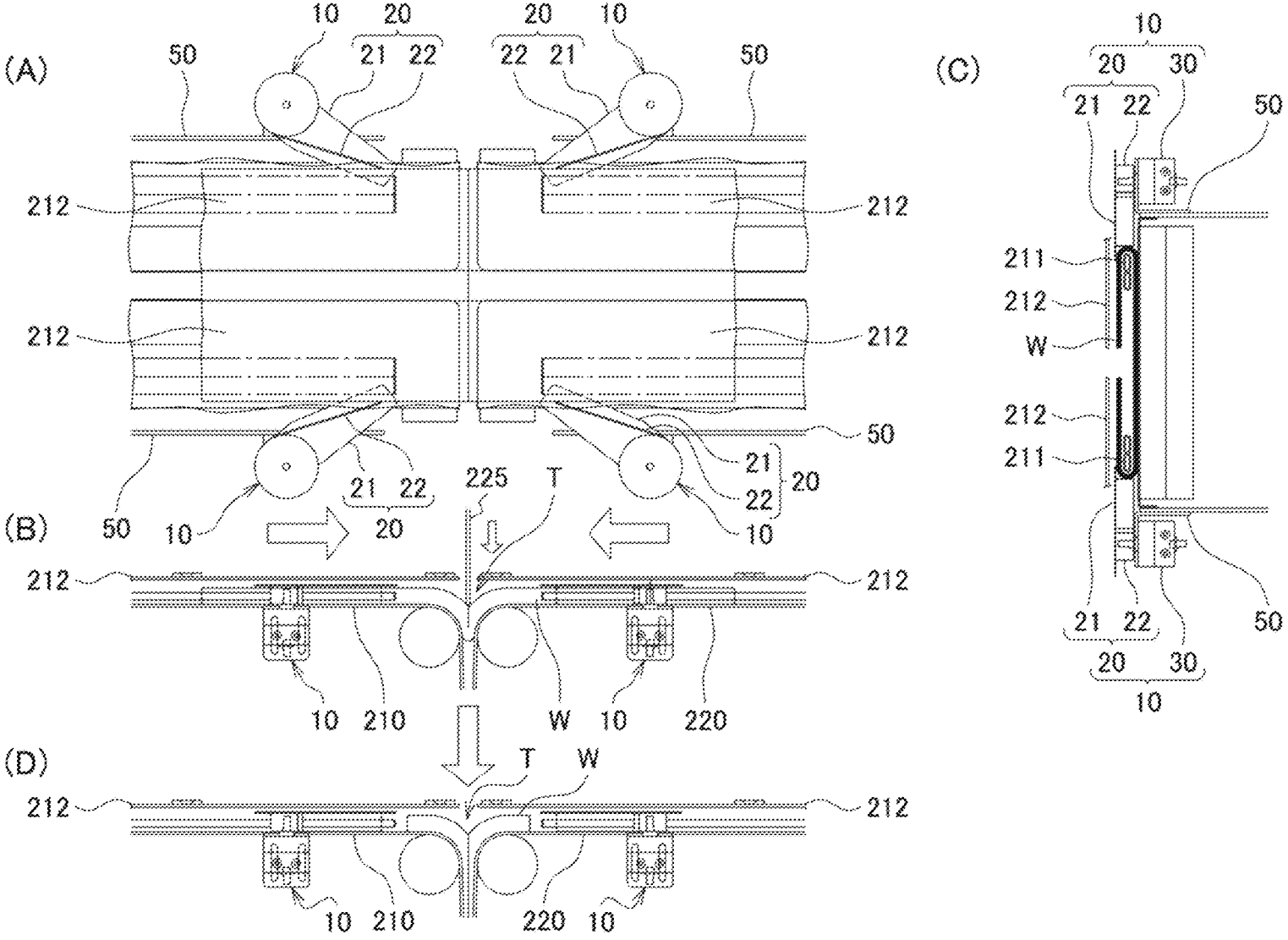
FIG. 5, A is a conceptual plan view showing a state in which the fabric in a state of being vertically tri-folded is to be further bi-folded in a state in which the folding assistance device of the first example is attached to the folding apparatus. B is a side view of A. C is a right side view of A. D is a side view of A in another state.

After the fabric W is French-folded, the driving portion 30 is driven, and the pressing portion 20 comes into contact with the fabric W. Since the fabric W is folded along the gauges 211 and 211, the fabric W is in a state of being interposed between the pressing portions 20 and the gauges 211 and 211, and the fabric W is in a state of being, so to speak, mountain-folded along the gauges 211 and 211 (refer to FIG. 4A and B).

In this case, since the gauge 211 is disposed on the inner side of the portion of the fabric W that is mountain-folded and the pressing portion 20 is in a state of being disposed on the outer side thereof, the mountain-folded portion of the fabric W is in a state of being interposed between the gauge 211 and the pressing portion 20. In addition, in this state, the first conveyor 210 and the second conveyor 220 start the transport again, and the fabric W is transported in a state of being interposed between the first conveyor 210 and the second conveyor 220 in a state of being bi-folded vertically, in the gap T between the first conveyor 210 and the second conveyor 220.

At the same time, since the fabric W is moved by the transport of the first conveyor 210 and the second conveyor 220 in a state of being interposed between the pressing portions 20 and the gauges 211 and 211, the interposed state is maintained, so that the portion is reliably folded while the portion that is mountain-folded is, so to speak, in a squeezed state, and a folding line obtained by bending the fabric W can be further emphasized and added at the interposed portion.

That is, in related art, the fabric W is folded by the two pairs of gauges 211 and 211 and the two pairs of folding portions 212 and 212, but in this case, the fabric W is only bent along the two pairs of gauges 211 and 211, the two pairs of gauges 211 and 211 only abut from the inside of the fabric W, and after the two pairs of gauges 211 and 211 are pulled out, the bent portion of the fabric W may be restored, so to speak, like being sprung back.

However, the interposed portion of the fabric W is, so to speak, in a state of being interposed from the inside and the outside of the fabric W by the two pairs of gauges 211 and 211 and the folding assistance device 10 of the first embodiment, and since the state is maintained for a while, the mountain-folded portion can be reliably folded. Further, since, as described above, the portion is, so to speak, in a state of being squeezed and the folding line is further emphasized and added, a case where the fabric W is made of nonwoven fabric is particularly effective. However, regardless of the type of the material of the fabric W, since the folded state can be reliably maintained and the folding line can be further added by using the folding assistance device 10 of the first example, it goes without saying that the folding assistance device 10 is also suitable for materials of synthetic fiber or cotton in related art, not limited to nonwoven fabric.

Figure 6:
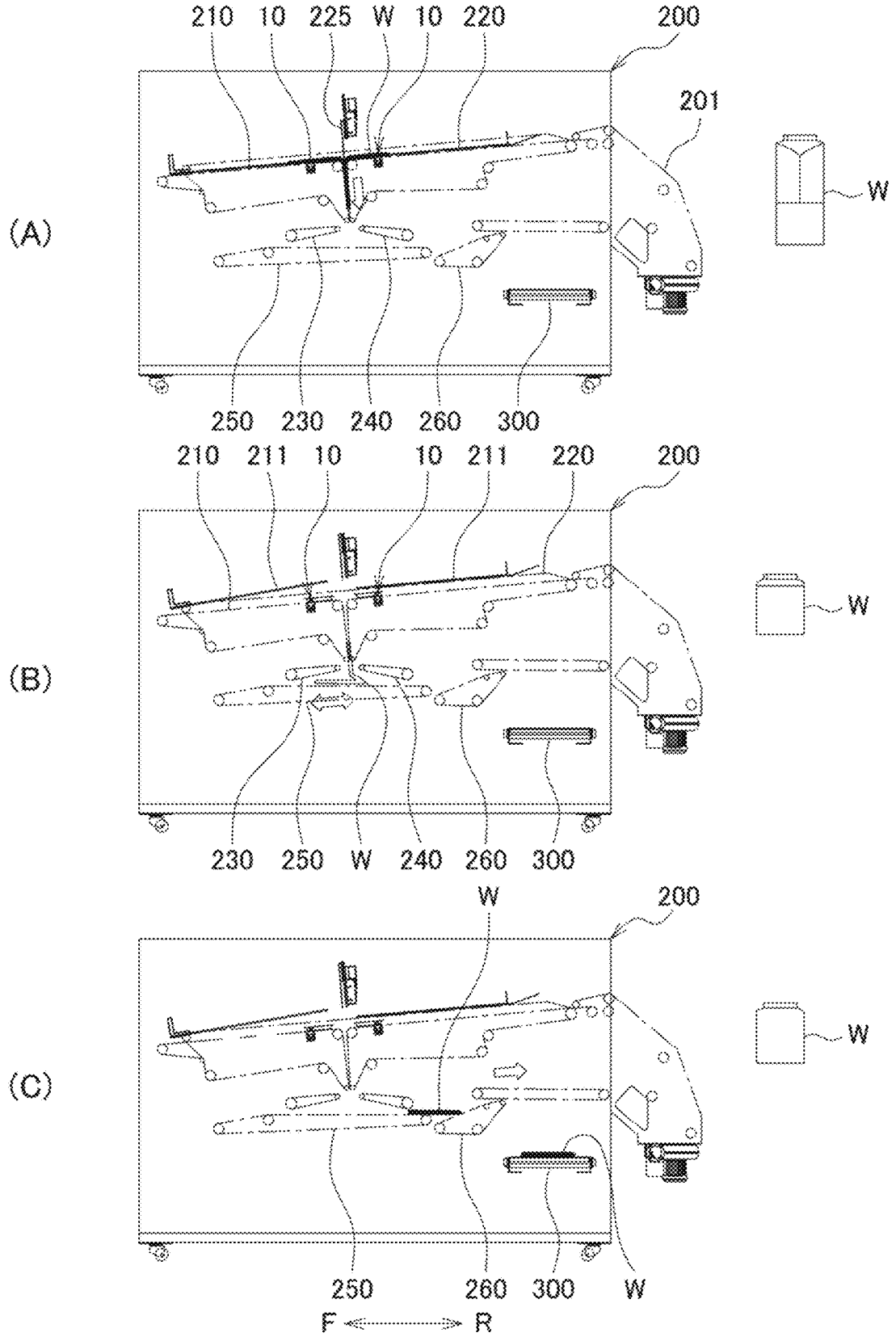
FIG. 6, A is a conceptual side view showing a state in which the fabric is further bi-folded. B is a side conceptual view of further bi-folding the further bi-folded fabric. C is a right side view concept diagram showing a state in which the bi-folded fabric is further stacked in the state of B.

Thereafter, the same operation is performed as that of the folding apparatus 200 in related art. In order to fold the hem portion of the fabric W that is so-called French-folded, the fabric W is transported to be interposed in the gap T between the first conveyor 210 and the second conveyor 220. Then, the fabric W is further bi-folded by the third conveyor 230 and the fourth conveyor 240. In addition, the fabric W is further transported by the sixth conveyor 260 from the fifth conveyor 250 and is placed on the stack portion 300 (refer to FIG. 6A, B, C).

Next, an up and down cylinder 60 that is driven up and down can be further disposed in the folding assistance device 10 of the first example. The up and down cylinder 60 is disposed to move the driving portion 30, to which the pressing portion 20 is attached, up and down, and can be moved up and down to correspond to the position of the gauge 211. Here, the reason for the correspondence to the position of the gauge 211 is that the gauge 211 is preferably made of metal having rigidity but may be slightly moved up and down since "bending" occurs even in a case of being made of metal, and the position of the pressing portion 20 is moved up and down by the up and down cylinder 60 to adapt to the bending, so that the fabric W is reliably interposed by the gauge 211 and the pressing portion 20. It is the same as the folding assistance device 10 of the first example except that the up and down cylinder 60 is disposed, so that the same reference numerals may be used, and the description thereof may be omitted. The up and down cylinder 60 is attached by an attachment portion 70.

Figure 7:
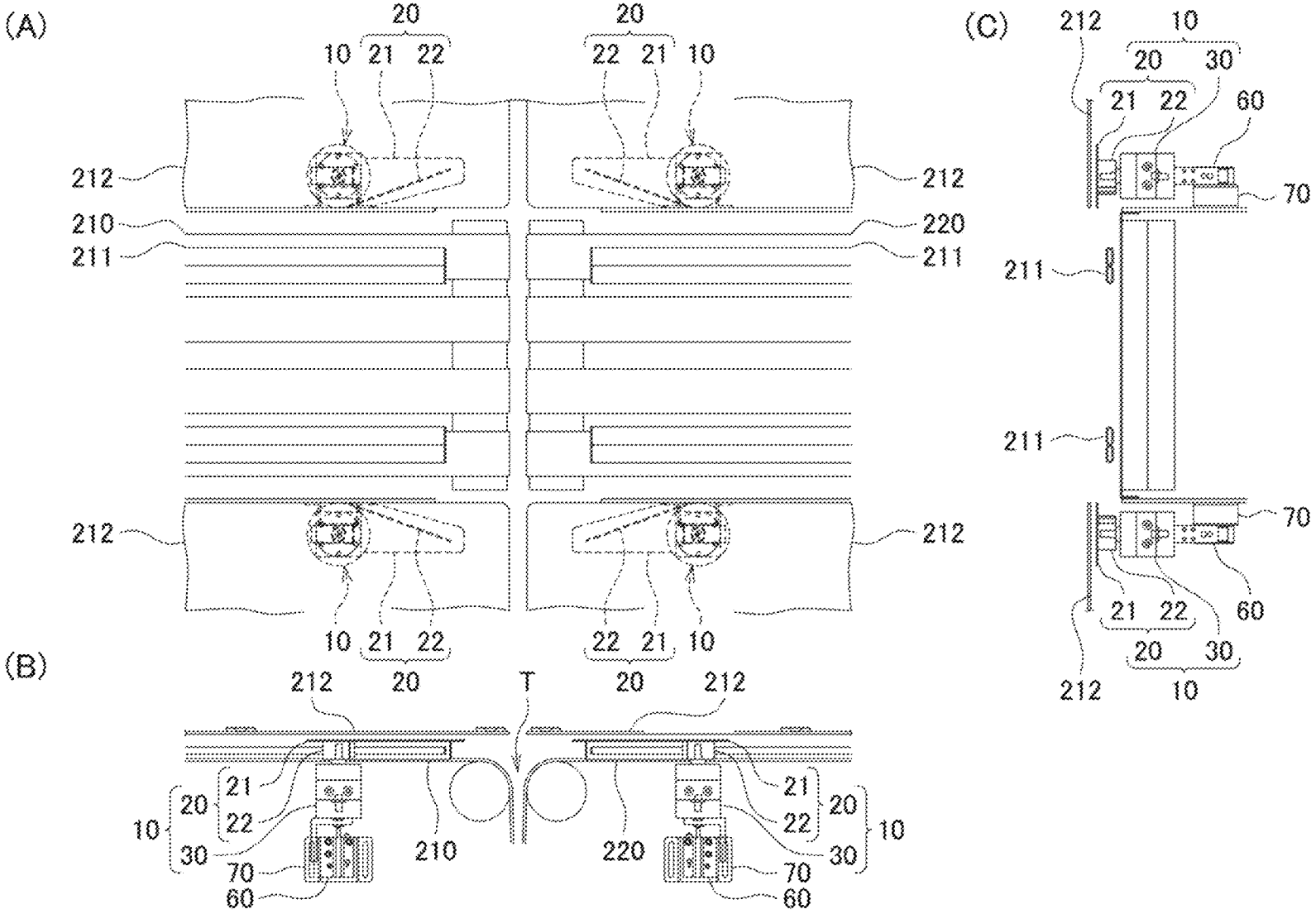
FIG. 7, A is a plan view showing a state in which the folding assistance device of the first example, to which a lifting device is attached, is attached to the folding apparatus. B is a side view of A. C is a right side view of A.
Figure 8:
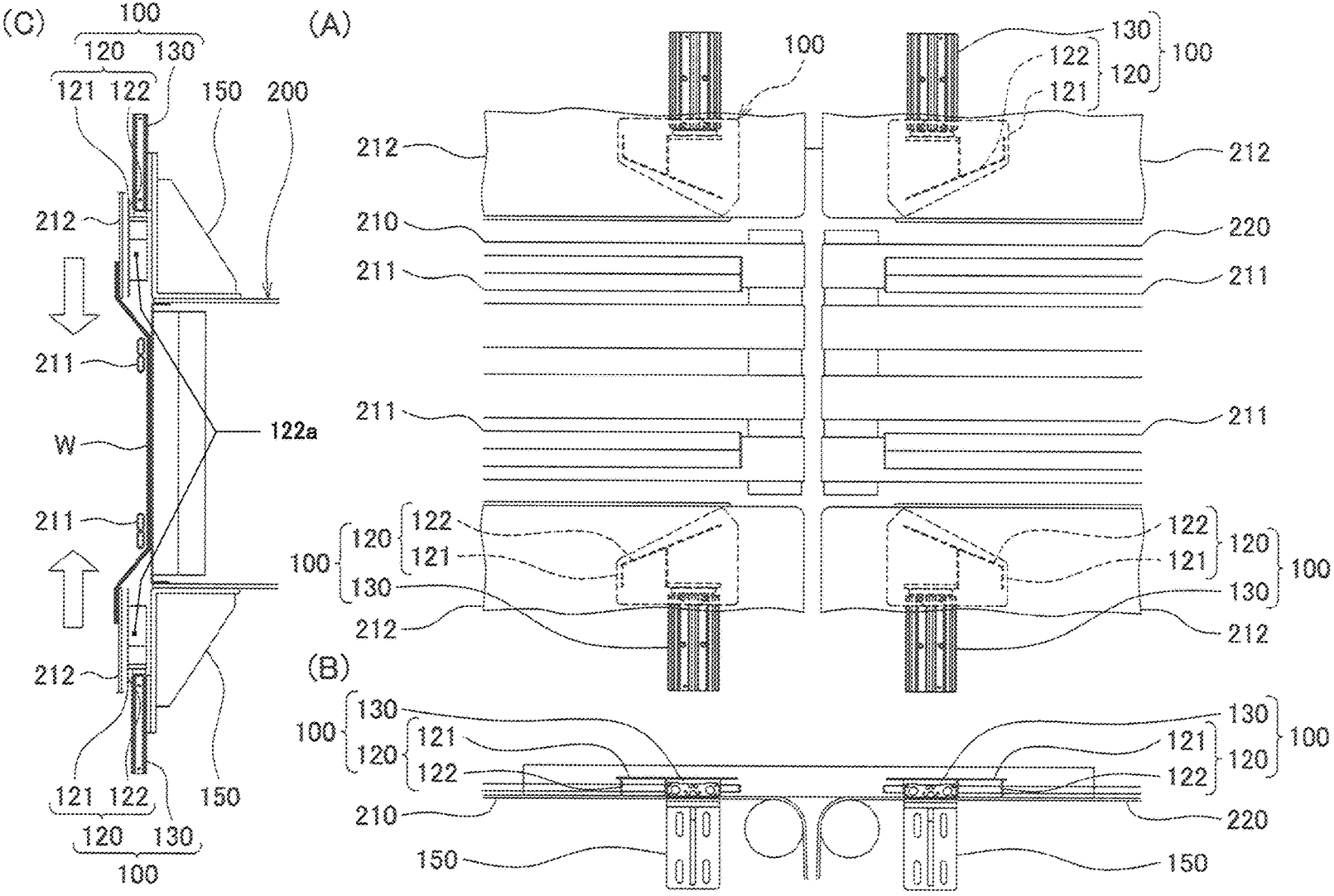
FIG. 8, A is a right side view of a state in which a folding assistance device according to a second example is attached to the folding apparatus. B is a plan view of the state of A. C is a right side view of a state in which the fabric is to be vertically tri-folded in a state in which the folding assistance device of the second example is attached to the folding apparatus.
Figure 9:
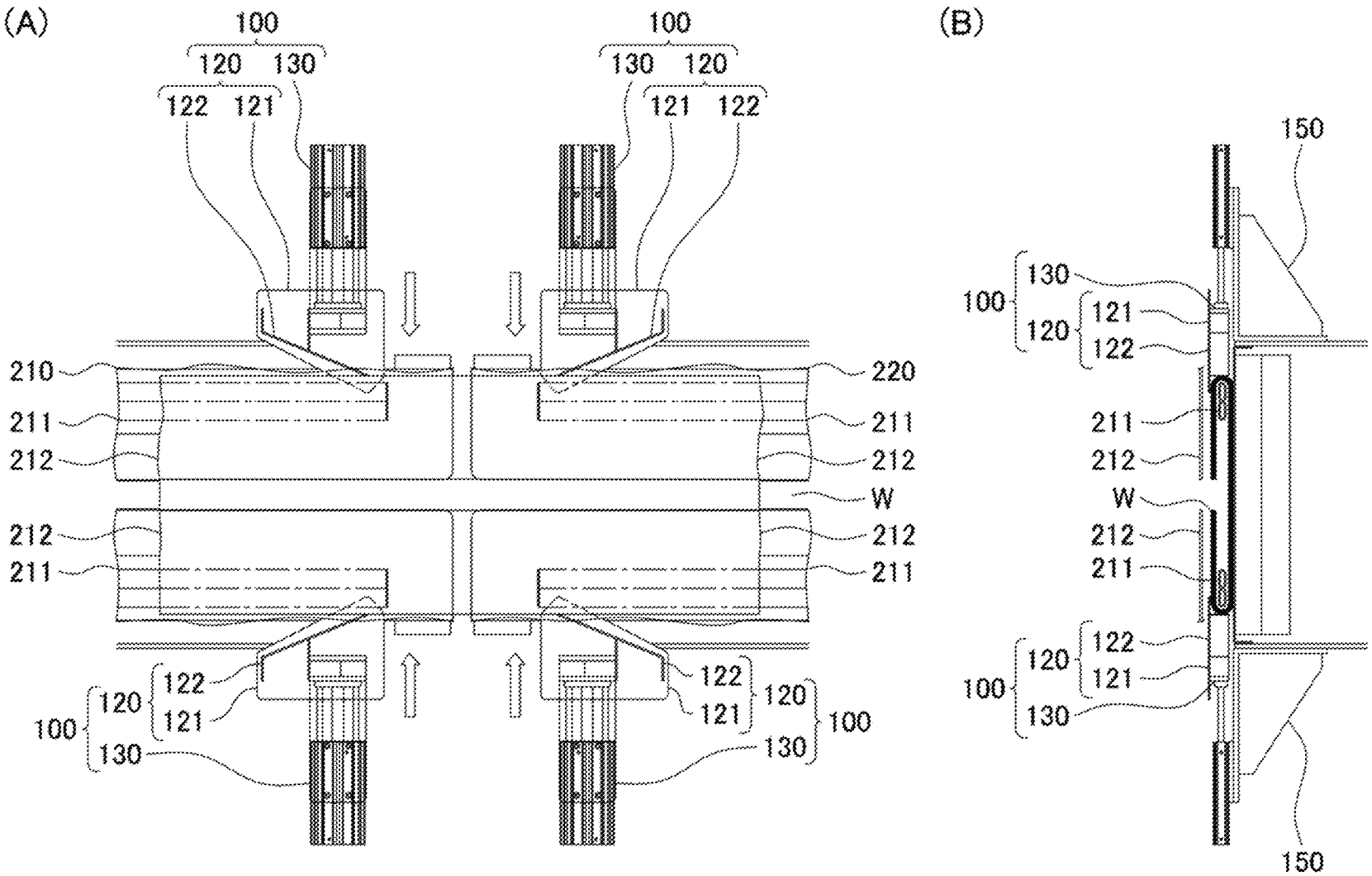
FIG. 9, A is a plan view of a state in which the fabric is vertically tri-folded in a state in which the folding assistance device of the second example is attached to the folding apparatus. B is a right side view of a state in which the fabric is vertically tri-folded.

The method of using the folding assistance device 10 of the first example including the up and down cylinder 60 is substantially the same as the folding assistance device 10 of the first example not including the up and down cylinder 60 described above. The different point is that the up and down cylinder 60 is moved up and down such that the driving portion 30 is driven to interpose the fabric W between the pressing portion 20 and the gauge 211 and then the up and down cylinder 60 is lowered such that the pressing portion 20 corresponds to the position of the gauge 211. Accordingly, since the other points are the same as those of the folding assistance device 10 of the first example, the description thereof will not be omitted (refer to FIG. 7A, B, C).

Next, a folding assistance device 100 of a second example will be described. In addition, the folding assistance device 100 of the second example includes a second pressing portion 120 that presses the gauge 211 through the fabric W, and a second driving portion 130 that drives the second pressing portion 120 to come into contact with the gauge 211 through the fabric W. The folding assistance device 100 of the second example is the same in that the fabric W is interposed between the gauge 211 and the second pressing portion 120, and the operation of the second driving portion 130 that drives the second pressing portion 120 is different. Accordingly, the point that the folding assistance device 100 of the second example can be disposed in each of the first conveyor 210 and the second conveyor 220 is the same.

The second pressing portion 120 includes a second upper end portion 121 that has a flat plate shape and a second main body portion 122 that has a wedge shape in plan view below the second upper end portion 121 and includes a second side portion 122*a* having a predetermined thickness. In addition, the second driving portion 130 drives the second main body portion 122 to move in the direction from the outside to the inside of the first conveyor 210 or the second conveyor 220, and is preferably a guided cylinder. In addition, the second driving portion 130 is attached to a second attachment portion 150, and the attachment portion 150 is attached to the folding apparatus 200. The predetermined thickness of the second side portion 122*a* is preferably a thickness that does not interfere with the position at which the folding portion 212 operates.

In addition, it is preferable that the second driving portion 130 can adjust the pressing force with which the fabric W is interposed between the gauges 211 and 211. This is also for preventing the pressing force by the second pressing portion 120 from being too strong such that the transport of the fabric W is stopped by the first conveyor 210 or the second conveyor 220, and conversely, for preventing the pressing force from being too weak to press the fabric W.

In addition, it is preferable that the second driving portion 130 drives the second pressing portion 120 to go straight with respect to the gauges 211 and 211. For example, the second driving portion 130 preferably moves straight from the outside to the inside of the first conveyor 210 and the second conveyor 220 or may move straight in a direction perpendicular to a direction of the transport of the first conveyor 210 and the second conveyor 220. In addition, for example, in a case where the pressing force of the second driving portion 130 with respect to the second pressing portion 120 is adjustable, the second driving portion 130 is preferably an air cylinder driven by air pressure or an electric cylinder driven by a motor.

The appropriate control of the pressing force with respect to the second pressing portion 120 by the second driving portion 130 is, for example, when the second driving portion 130 is an air cylinder driven by air pressure, to adjust the pressing force with respect to the second pressing portion 120 by adjusting the air pressure in advance by an operator (not shown) depending on the type of the fabric W, and by the adjustment, it is possible to prevent the transport by the first conveyor 210 or the second conveyor 220 from being stopped. In addition, for example, when the second driving portion 130 is an electric cylinder driven by a motor, the pressing force with respect to the second pressing portion 120 can be adjusted by adjusting the torque of the motor. Accordingly, even in this case, it is possible to prevent the transport by the first conveyor 210 or the second conveyor 220 from being stopped.

That is, when the second pressing portion 120 excessively presses the fabric W by the second driving portion 130, the transport by the first conveyor 210 or the second conveyor 220 is stopped, but the pressing force with respect to the second pressing portion 120 is adjusted by adjusting the air cylinder driven by the air pressure or the electric cylinder driven by the motor, which is the second driving portion 130, in advance, so that the transport by the first conveyor 210 or the second conveyor 220 is prevented from being stopped. In this way, by adjusting the pressing force of the second driving portion 130, the pressing force of the second driving portion 130 with respect to the second pressing portion 120 does not resist the transport force of the first conveyor 210 or the second conveyor 220, and the productivity is not reduced.

Next, a method of using the folding assistance device 100 of the second example by attaching the folding assistance device 100 to the folding apparatus 200 will be described. In the folding apparatus 200, the folding assistance device 100 of the second example is disposed on each of the first conveyor 210 and the second conveyor 220. In plan view, the folding assistance device 100 is attached to, in a direction perpendicular to the transport direction of the first conveyor 210, for example, in a case where the first conveyor 210 is compared to a river, positions corresponding to both banks of the river via the second attachment portion 150. Specifically, the second driving portion 130 of the second example is attached to the second attachment portion 150, and the second pressing portion 120 is attached to the second driving portion 130.

In this state, the fabric W is disposed to straddle the first conveyor 210 and the second conveyor 220. In this state, the two pairs of gauges 211 and 211 are lowered to press the fabric W. In this case, the two pairs of gauges 211 and 211 are placed at positions that divide the fabric W in a width direction into three, and then the two pairs of folding portions 212 and 212 move, in a case where the transport of the conveyor is compared to a flow of a river, from positions abutting both banks of the river in an alternating manner to a position corresponding to a so-called center portion of the river to skim the gauges 211 and 211 from the positions abutting both banks of the river, so that folding, so-called French folding (body tri-folding) is performed along the long dimension direction of the fabric W and at the positions that divide the fabric W in the width direction into three. This point is the same as that of the folding assistance device 10 of the first example.

In this case, since the gauge 211 is disposed on the inner side of a portion at which the fabric W is mountain-folded and the second pressing portion 120 is in a state of being disposed on the outer side thereof, the portion can be reliably bent. In addition, in this state, the first conveyor 210 and the second conveyor 220 start the transport again, and the fabric W is transported in a state of being interposed between the first conveyor 210 and the second conveyor 220 in a state of being bi-folded in the gap T between the first conveyor 210 and the second conveyor 220.

At the same time, since the fabric W is moved by the transport of the first conveyor 210 and the second conveyor 220 in a state of being interposed between the second pressing portions 120 and the gauges 211 and 211, the interposed state is maintained, so that the fabric W can be reliably folded while the portion is, so to speak, in a squeezed state, and a folding line obtained by bending the fabric W can be further emphasized and added at the interposed portion. This is particularly effective in a case where the fabric W is a nonwoven fabric. The following steps are the same as those of the folding apparatus 200 including the folding assistance device 10 of the first example, and the description thereof will be omitted. By appropriately controlling the pressing force of the second driving portion 130 with respect to the second pressing portion 120, the fabric W is not damaged, and by preventing the transport by the first conveyor 210 or the second conveyor from being stopped due to the excessive pressing of e fabric W, so to speak, there is no resistance against the transport force of the first conveyor 210 or the second conveyor 220, so that the fact that the productivity is not reduced is the same.

As described above, not only the folding assistance device 10 of the first example but also the folding assistance device 100 of the second example is not limited to a fabric with so-called stiffness, such as a nonwoven fabric, that is, a relatively rigid fabric, and can reliably fold the fabric. In addition, by transporting the fabric W in this state by the first conveyor 210 and the second conveyor 220, the folding crease can be attached to the portion of the fabric W interposed between the first pressing portion 20 or the second pressing portion 120 and the gauges 211 and 211, and the folded state can be maintained. As described above, the folding assistance device 10 of the first example or the folding assistance device 100 of the second example is not limited to a fabric that is highly elastic such as a nonwoven fabric so that it is unlikely to add a folding crease and is easily returned to the original state even in a case where the fabric is folded, that is, has rigidity or stiffness, but can also reliably fold the fabric W such as cotton or synthetic fiber.

In this way, it is possible to provide the folding assistance device 10 of the first example or the folding assistance device 100 of the second example and the folding apparatus 200 including the folding assistance device 10 or the folding assistance device 100.

REFERENCE SIGNS LIST

10: folding assistance device of first example
20: pressing portion
30: driving portion
21: upper end portion
22*a*: side portion
22: main body portion
30: driving portion
50: attachment portion
60: up and down cylinder
100: folding assistance device of second example
120: second pressing portion
130: second driving portion
121: second upper end portion
122*a*: second side portion
150: second attachment portion
200: folding apparatus
201: insert conveyor
210: first conveyor
220: second conveyor
211: gauge
212: folding portion
230: third conveyor
240: fourth conveyor
250: fifth conveyor
300: stack portion
W: fabric

The invention claimed is:

1. A folding assistance device comprising:

a pressing portion that is attached to a folding apparatus including a folding portion and a gauge that defines a folding position for folding a fabric and presses the fabric towards the gauge to fold the fabric at the folding position with the fabric interposed therebetween, wherein in a case when the fabric is folded at the folding position, the folding portion presses an upper edge of the folded fabric and the pressing portion presses a side edge of the folded fabric; and a driving portion that drives the pressing portion to come into contact with the gauge.

2. A folding assistance device for folding a fabric comprising:

a pressing portion that is attached to a folding apparatus including a folding portion, a gauge that defines a folding position for folding a fabric, and a conveyor that transports the fabric and presses the fabric towards the gauge to fold the fabric at the folding position with the fabric interposed therebetween, wherein in a case when the fabric is folded at the folding position, the folding portion presses an upper edge of the folded fabric and the pressing portion presses a side edge of the folded fabric; and a driving portion that drives the pressing portion to come into contact with the gauge, wherein the fabric is transported by the conveyor while being pressed against a pair of the gauges by the pressing portion.

3. The folding assistance device according to claim 1, wherein the driving portion is configured to adjust a pressing force for pressing the gauge with the fabric interposed therebetween.

4. The folding assistance device according to claim 1, wherein the driving portion rotates the pressing portion in plan view to press the gauge with the fabric interposed therebetween.

5. The folding assistance device according to claim 4, wherein the driving portion is a rotary actuator.

6. The folding assistance device according to claim 1, wherein the driving portion makes the pressing portion go straight to press the gauge with the fabric interposed therebetween.

7. The folding assistance device according to claim 6, wherein the driving portion is an air cylinder or an electric cylinder.

8. A folding apparatus comprising: the folding assistance device according to claim 1.

9. The folding assistance device according to claim 2, wherein the driving portion is configured to adjust a pressing force for pressing the gauge with the fabric interposed therebetween.

10. The folding assistance device according to claim 2, wherein the driving portion rotates the pressing portion in plan view to press the gauge with the fabric interposed therebetween.

11. The folding assistance device according to claim 3, wherein the driving portion rotates the pressing portion in plan view to press the gauge with the fabric interposed therebetween.

12. The folding assistance device according to claim 2, wherein the driving portion makes the pressing portion go straight to press the gauge with the fabric interposed therebetween.

13. The folding assistance device according to claim 3, wherein the driving portion makes the pressing portion go straight to press the gauge with the fabric interposed therebetween.

14. A folding apparatus comprising: the folding assistance device according to claim 2.

15. A folding apparatus comprising: the folding assistance device according to claim 3.

16. A folding apparatus comprising: the folding assistance device according to claim 4.

17. A folding apparatus comprising: the folding assistance device according to claim 5.

18. A folding apparatus comprising: the folding assistance device according to claim 6.

19. A folding apparatus comprising: the folding assistance device according to claim 7.

* * * * *